US010379472B2

(12) United States Patent
Tsubotani

(10) Patent No.: US 10,379,472 B2
(45) Date of Patent: Aug. 13, 2019

(54) FUSING APPARATUS WITH A ROTATING ENDLESS BELT, AND IMAGE FORMING APPARATUS

(71) Applicant: KONICA MINOLTA, INC., Tokyo (JP)

(72) Inventor: Yoshikazu Tsubotani, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/059,433

(22) Filed: Aug. 9, 2018

(65) Prior Publication Data

US 2019/0064710 A1 Feb. 28, 2019

(30) Foreign Application Priority Data

Aug. 29, 2017 (JP) ..... 2017-163879

(51) Int. Cl.
*G03G 15/20* (2006.01)

(52) U.S. Cl.
CPC ..... *G03G 15/206* (2013.01); *G03G 15/2053* (2013.01); *G03G 15/2064* (2013.01); *G03G 2215/2035* (2013.01); *G03G 2215/2038* (2013.01)

(58) Field of Classification Search
CPC ..... G03G 15/206; G03G 15/2028; G03G 15/2053; G03G 15/2064; G03G 2215/2035; G03G 2215/2038; G03G 2215/2019
USPC ..... 399/329
See application file for complete search history.

(56) References Cited

U.S. PATENT DOCUMENTS

2005/0036809 A1* 2/2005 Fukita ..... G03G 15/206 399/328
2016/0223964 A1* 8/2016 Ikebuchi ..... G03G 15/2064

FOREIGN PATENT DOCUMENTS

| | | | | |
|---|---|---|---|---|
| JP | 2005221533 A | * | 8/2005 | |
| JP | 2010-224082 A | | 10/2010 | |
| JP | 2013156399 A | * | 8/2013 | ..... G03G 15/2064 |
| JP | 2014134701 A | * | 7/2014 | ..... G03G 15/2053 |
| JP | 2014232337 A | * | 12/2014 | |
| JP | 2015114394 A | * | 6/2015 | |
| JP | 2017-072711 A | | 4/2017 | |

* cited by examiner

*Primary Examiner* — Robert B Beatty
(74) *Attorney, Agent, or Firm* — Buchanan Ingersoll & Rooney PC

(57) ABSTRACT

A fusing apparatus includes: a rotating endless belt; a pressing member pressing the belt from an inside of the belt; and a roller forming the fusing nip between the roller and the belt by pressing, from an outside of the belt, a position where the belt faces the pressing member, wherein a surface of the pressing member facing the roller via the belt includes: plane surface, and a curved surface adjacent to the plane surface at a downstream-side end in a conveying direction of the storage medium of the plane surface, and when viewed from a cross-section orthogonal to a central axis of the roller, an upstream-side end of the conveying direction of the plane surface is away from a straight line passing through the central axis of the pressure roller and parallel to the conveying direction, farther than the downstream-side end in the conveying direction of the plane surface.

11 Claims, 8 Drawing Sheets

FIG. 6

| RIGIDITY [°] | PRESSURE INCLINATION | PEAK PRESSURE | IMAGE QUALITY |
|---|---|---|---|
| 30 | × | × | × |
| 40 | ○ | ○ | ○ |
| 50 | ○ | ○ | ○ |
| 60 | ○ | ○ | ○ |
| 70 | × | ○ | × |

PRESSURE INCLINATION ○: NO DECREASE IN PRESSURE IN SECTION FROM NIP INLET TO PEAK PRESSURE

PRESSURE INCLINATION ×: DECREASE IN PRESSURE IN SECTION FROM NIP INLET TO PEAK PRESSURE

PEAK PRESSURE ○: 50 kPa OR GREATER IN PEAK PRESSURE

PEAK PRESSURE ×: LESS THAN 50 kPa IN PEAK PRESSURE

IMAGE QUALITY ○: LOWERING TEMPERATURE BY 5°C OR HIGHER THAN CONVENTIONAL IN EQUAL QUALITY

IMAGE QUALITY ×: LOWERING TEMPERATURE BY LESS THAN 5°C THAN CONVENTIONAL IN EQUAL QUALITY

FIG. 7

| INCLINATION ANGLE $\theta$ [°] | PRESSURE INCLINATION | IMAGE QUALITY |
|---|---|---|
| 0 | × | × |
| 0.5 | ○ | ○ |
| 10 | ○ | ○ |
| 20 | ○ | ○ |
| 25 | ○ | ○ |
| 25 | × | × |

PRESSURE INCLINATION ○: NO DECREASE IN PRESSURE IN SECTION FROM NIP INLET TO PEAK PRESSURE

PRESSURE INCLINATION ×: DECREASE IN PRESSURE IN SECTION FROM NIP INLET TO PEAK PRESSURE

IMAGE QUALITY ○: LOWERING TEMPERATURE BY 5°C OR HIGHER THAN CONVENTIONAL IN EQUAL QUALITY

IMAGE QUALITY ×: LOWERING TEMPERATURE BY LESS THAN 5°C THAN CONVENTIONAL IN EQUAL QUALITY

FUSING APPARATUS WITH A ROTATING ENDLESS BELT, AND IMAGE FORMING APPARATUS

The entire disclosure of Japanese patent Application No. 2017-163879, filed on Aug. 29, 2017, is incorporated herein by reference in its entirety.

BACKGROUND

Technological Field

The present invention relates to a fusing apparatus and an image forming apparatus. More specifically, the invention relates to a fusing apparatus including a pressing member that presses a belt from the inside and an image forming apparatus.

Description of the Related Art

Examples of electrophotographic image forming apparatuses include: multifunction peripherals (MFPs) equipped with functions including a scanner, a facsimile, a copier, a printer, data communication, and a server, facsimile machines; copiers; and printers.

Image forming apparatuses generally develop an electrostatic latent image formed on an image carrier to form a toner image with a developing device, and transfer the toner image to a storage medium. Thereafter, the image forming apparatuses allow a fusing apparatus to fuse the toner image on a sheet, thereby forming an image on the storage medium. Additionally, some image forming apparatuses develop an electrostatic latent image formed on an image carrier to form a toner image with a developing device, transfer the toner image to an intermediate transfer belt with a primary transfer roller, and then secondarily transfer, to a storage medium with a secondary transfer roller, the toner image on the intermediate transfer belt.

Some fusing apparatuses include a rotating endless belt, a pressing member that presses a fusing nip from the inside of the belt, and a roller that forms a fusing nip between the roller and the belt by pressing the belt to the pressing member. Conventional configurations of this type of fusing apparatuses are disclosed, for example, in JP 2017-72711 A and JP 2010-224082 A.

A fusing apparatus disclosed in JP 2017-72711 A includes a fusing belt, a pressurizing member, and a pressing member. The fusing belt is rotatably provided around a rotary shaft. The pressurizing member comes into press-contact with the fusing belt to form a fusing nip and is rotatably provided. The pressing member has a pressing surface that presses the fusing belt toward the pressurizing member side. The pressing surface has a plane surface extending along a conveying direction of a storage medium, and a curved surface provided on a downstream side of the plane surface in the conveying direction of the storage medium and curved along the outer periphery surface of the pressurizing member. The curvature radius of the curved surface is larger than the curvature radius of the outer periphery surface of the pressurizing member before the pressurizing member deforms along with formation of the fusing nip.

A fusing apparatus disclosed in JP 2010-224082 A includes: a rotatable endless heating belt; a rotatable pressurizing roller that comes into press-contact with the heating belt; a heat source that heats the heating belt; a nip area where the heating belt comes into contact with the pressurizing roller, and a holding member. The holding member has a guide surface that is fixedly installed, inside the heating belt, to the main body of the device, pressed by pressurizing roller, and guides the heating belt to move on a predetermined path in the nip area. The guide surface, at a portion located in the nip area, inclines on a pressurizing roller side toward a downstream side in a sheet conveying direction.

In recent years, power conservation of image forming apparatuses has been required due to increase in awareness of energy consumption. Power consumption in fusing apparatuses accounts for a large portion of power consumption in the image forming apparatuses. Therefore, as a technique of power saving for image forming apparatuses, a method of reducing power consumption in fusing apparatuses by setting the fusing temperature low can be considered.

For the conventional fusing apparatuses described above, setting the fusing temperature low has not been achieved. In the fusing apparatus disclosed in JP 2017-72711 A, the pressing surface of the pressing member includes a plane surface and a curved surface, and the plane surface extends along a conveying direction of a storage medium. In a fusing apparatus disclosed in JP 2010-224082 A, a guide surface of only a holding member includes a plane surface. In these configurations, a distribution in pressure that is received by a storage medium, at a fusing nip, becomes maximum at a substantially center of the fusing nip along a conveying direction. Therefore, such fusing apparatuses heat toner on the storage medium just for a short period of time while the storage medium moves from an upstream-side end of the fusing nip to a central position thereof. The fusing apparatuses have fused the toner on the storage medium at a substantially central position of the fusing nip along the conveying direction, prior to sufficient heating of the toner. As a result, insufficient use of heat applied by the fusing apparatuses has caused a fusing failure when the fusing temperature has been set low.

The present invention is made to solve the problems described above, and an object of the invention is to provide a fusing apparatus and an image forming apparatus that enable reduction in power consumption.

SUMMARY

The present invention has been made to solve the problems described above, and an object thereof is to provide a fusing apparatus and an image forming apparatus that enable reduction in power consumption.

To achieve the abovementioned object, according to an aspect of the present invention, a fusing apparatus that fuses a toner image on a storage medium by passing the storage medium through a fusing nip reflecting one aspect of the present invention comprises: a rotating endless belt; a pressing member that is provided inside the belt and presses the belt from an inside of the belt; and a roller that is provided outside the belt and forms the fusing nip between the roller and the belt by pressing, from an outside of the belt, a position where the belt faces the pressing member, wherein a surface of the pressing member facing the roller via the belt includes: plane surface, and a curved surface adjacent to the plane surface at a downstream-side end in a conveying direction of the storage medium of the plane surface, and when viewed from a cross-section orthogonal to a central axis of the roller, an upstream-side end of the conveying direction of the plane surface is away from a straight line passing through the central axis of the pressure roller and parallel to the conveying direction, farther than the downstream-side end in the conveying direction of the plane surface.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 6 is a table indicating a relationship between surface rigidity (rubber rigidity) of the pressurizing roller, pressure inclination, peak pressure, and image quality at the fusing nip NP, in the fusing apparatus of the embodiment of the present invention;

FIG. 7 is a table indicating a relationship between the inclination angle θ of a plane surface of the fusing belt, pressure inclination, and image quality at the fusing nip, in the fusing apparatus of the embodiment of the present invention:

DETAILED DESCRIPTION OF EMBODIMENTS

Hereinafter, one or more embodiments of the present invention will be described with reference to the drawings. However, the scope of the invention is not limited to the disclosed embodiments.

The embodiment described below will explain a case where an image forming apparatus is a multifunction peripheral (MFP) to be equipped with a fusing apparatus. The image forming apparatus to be equipped with a fusing apparatus may be a facsimile, a copier or a printer, in addition to an MFP.

Figure 1:
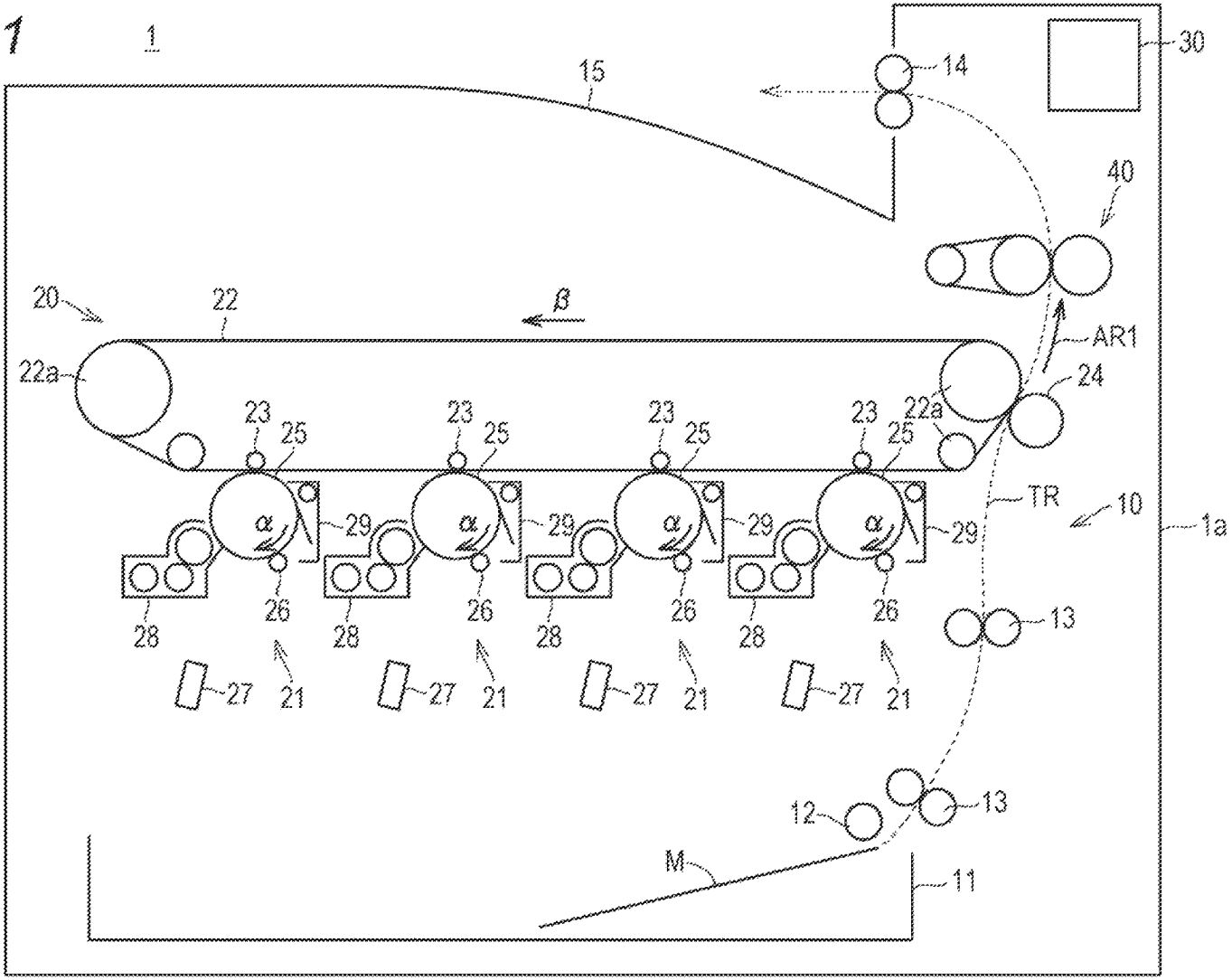
FIG. 1 is a cross-sectional view schematically illustrating an image forming apparatus in one embodiment of the present invention.

FIG. 1 is a cross-sectional view schematically illustrating an image forming apparatus 1 in one embodiment of the present invention.

With reference to FIG. 1, the image forming apparatus 1 in the present embodiment is an MFP, and mainly includes a sheet conveying part 10, a toner image former 20 (one example of image former), a controller 30, and a fusing apparatus 40.

The sheet conveying part 10 conveys a sheet M (one example of storage medium) in a conveying direction indicated by an arrow AR1, along a conveying path TR. The sheet conveying part 10 includes a paper feed tray 11, a paper feeding roller 12, a plurality of conveying rollers 13, a paper delivery roller 14, and a paper delivery tray 15. The paper feed tray 11 houses a sheet M for forming an image. A plurality of paper feed trays 11 may be provided. The paper feeding roller 12 is provided between the paper feed tray 11 and the conveying path TR. Each of the conveying rollers 13 is provided along the conveying path TR. The paper delivery roller 14 is provided on the most downstream of the conveying path TR. The paper delivery tray 15 is provided on the uppermost portion of an image forming apparatus main body 1*a*.

The toner image former 20 is so-called a tandem type and combines images in four colors: yellow (Y), magenta (M), cyan (C), and black (K) to form a toner image on a sheet M that is to be conveyed. The toner image former 20 includes an image former 21 for Y, M. C, and K in color, an intermediate transfer belt 22, a primary transfer roller 23 for Y, M, C, and K in color, and a secondary transfer roller 24.

The image former 21 for Y, M, C, and K in color includes, for example, a photosensitive drum 25, a charging roller 26, an exposing device 27, a developing device 28, and a cleaning device 29. The photosensitive drum 25 is rotationally driven in a direction indicated by arrow α in FIG. 1. The charging roller 26, the developing device 28, and the cleaning device 29 are provided around the photosensitive drum 25. The charging roller 26 is provided in proximity to the photosensitive drum 25. The exposing device 27 is provided below the photosensitive drum 25.

The intermediate transfer belt 22 is provided on the upper portion of the image former 21 for Y, M. C, and K in color. The intermediate transfer belt 22 is annular and is wound around rotary rollers 22*a*. The intermediate transfer belt 22 is rotationally driven in a direction indicated by arrow β in FIG. 1. The primary transfer rollers 23 are opposite to the photosensitive drum 25 across the intermediate transfer belt 22, one by one. The secondary transfer roller 24 is in contact with the intermediate transfer belt 22 in the conveying path TR.

The fusing apparatus 40 conveys, along the conveying path TR, a sheet M with a toner image carried, while grasping the sheet M, thereby fusing the toner image on the sheet M.

In the image forming apparatus 1, the photosensitive drum 25 rotates and t the charging roller 26 charges a surface of the photosensitive drum 25. In the image forming apparatus 1, according to image forming information, the exposing device 27 exposes the charged surface of the photosensitive drum 25 to form an electrostatic latent image on the surface of the photosensitive drum 25.

Next, in the image forming apparatus 1, toner is supplied from the developing device 28 to the photosensitive drum 25 with the electrostatic latent image formed, for performing development to form a toner image on the photosensitive drum 25.

Then, the image forming apparatus 1 employs the primary transfer roller 23 to transfer sequentially, onto a surface of the intermediate transfer belt 22, the toner image formed on the photosensitive drum 25 (primary transfer). For full color images, a toner image in which toner images of Y. M. C, and K in color are combined is formed, on the surface of the intermediate transfer belt 22.

The image forming apparatus 1 removes, by the cleaning device 29, toner that is not transferred to the intermediate transfer belt 22 and remains on the photosensitive drum 25.

Continuously, the image forming apparatus 1 conveys, to a position facing the secondary transfer roller 24, the toner image formed on the surface of the intermediate transfer belt 22 by using the rotary roller 22*a*

Additionally, the image forming apparatus 1 feeds, by using the paper feeding roller 12, a sheet M housed in the paper feed tray 11. The image forming apparatus 1 then, by using the plurality of conveying rollers 13, guides the sheet M, along the conveying path TR, between the intermediate transfer belt 22 and the secondary transfer roller 24. Thereafter, the image forming apparatus 1 transfers the toner image formed on the surface of the intermediate transfer belt 22 to the sheet M with the secondary transfer roller 24.

The image forming apparatus 1 guides, to the fusing apparatus 40, the sheet M with the toner image transferred, and then the fusing apparatus 40 fuses the toner image on the sheet M. Thereafter, the image forming apparatus 1 delivers the sheet M with the toner image fused to the paper delivery tray 15 by the paper delivery roller 14.

The controller 30 includes, for example, a central processing unit (CPU) that controls the entire image forming apparatus 1 according to a control program, a read only memory (ROM) in which the control program is stored, and a random access memory (RAM) that constitutes a work area for the CPU.

Figure 2:
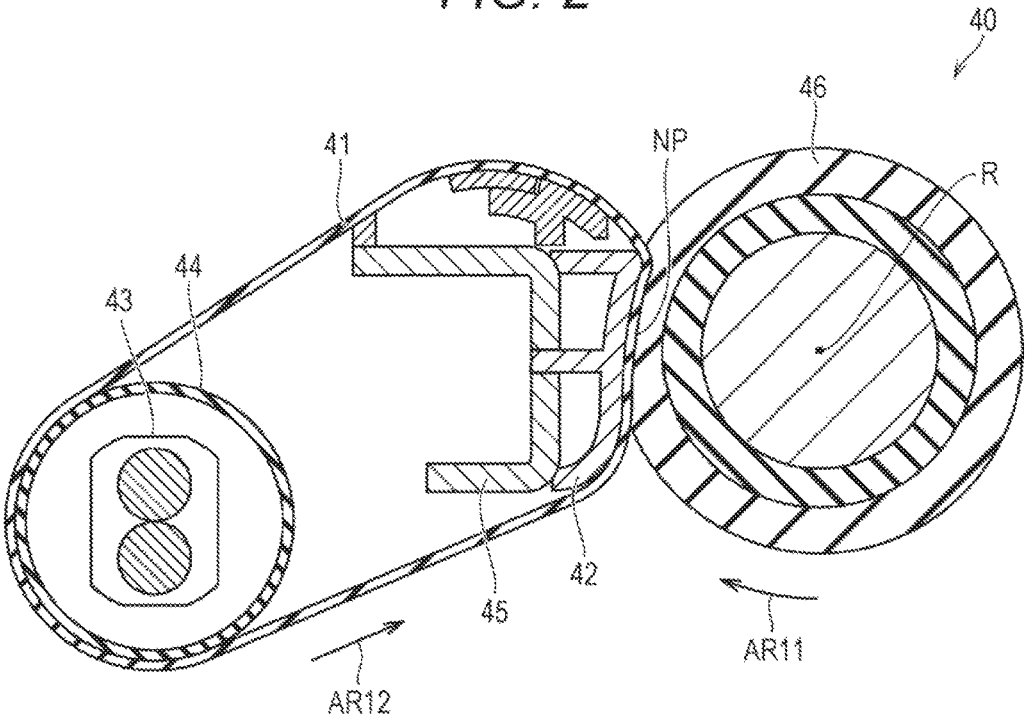
FIG. 2 is a cross-sectional view schematically illustrating a configuration of a fusing apparatus in the embodiment of the present invention.
Figure 3:
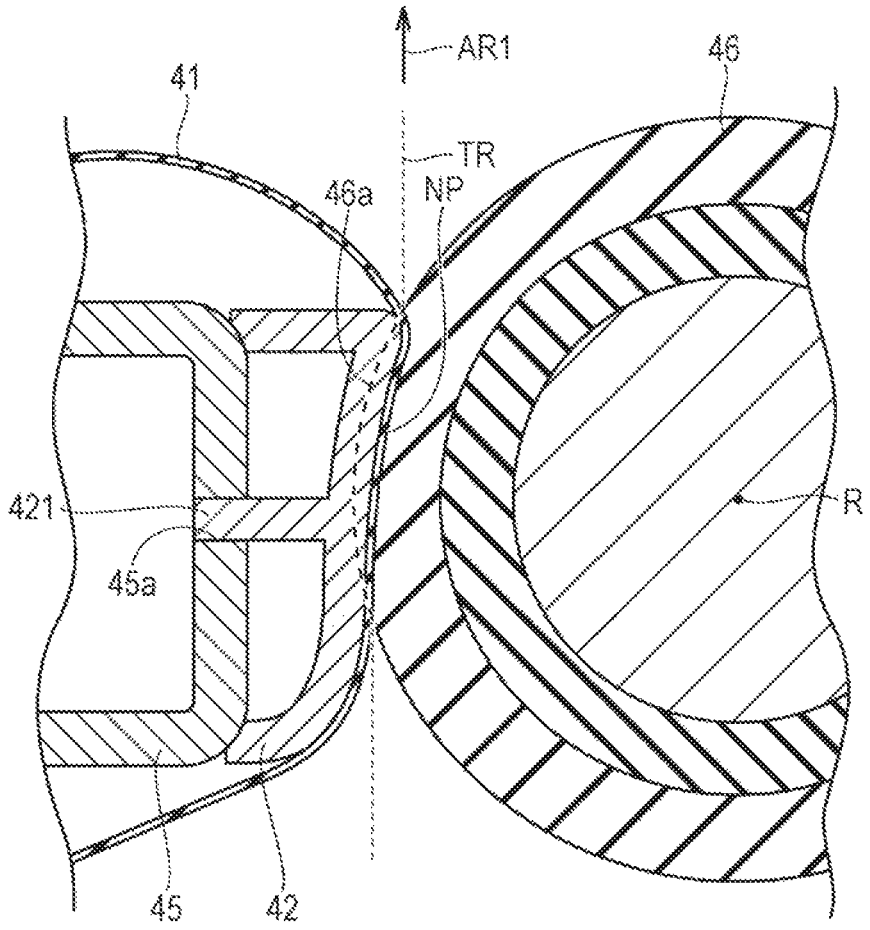
FIG. 3 is an enlarged cross-sectional view illustrating a configuration near a fusing nip in FIG. 2.

FIG. 2 is a cross-sectional view schematically illustrating a configuration of the fusing apparatus 40 in the embodiment of the present invention. FIG. 3 is an enlarged cross-sectional view illustrating a configuration near a fusing nip NP in FIG. 2. Note that, FIGS. 2 to 4B illustrate cross sections orthogonal to the central axis R of a pressurizing roller 46.

With reference to FIGS. 2 and 3, the fusing apparatus 40 employs a system of supporting a fusing belt by two shafts. The fusing apparatus 40 includes a fusing belt 41 (one example of belt), a pad (nip forming member) 42 (one example of pressing member), a heater (heat source, heating body) 43, a heating roller 44, a pad frame 45, and the pressurizing roller 46 (one example of roller). The fusing apparatus 40 fuses the toner image on a sheet by passing the sheet through the fusing nip NP.

The fusing belt 41 is an endless belt. The fusing belt 41 is clamped by unillustrated guide members (side plates) at both ends in a shaft direction, and thus is supported at a position where the fusing nip NP is to be formed by press-contacting with the pressurizing roller 46. The fusing belt 41 is wound around the pad 42 and the heating roller 44. Tension is given to the fusing belt 41 by a biasing part (not illustrated).

The pad 42 is provided inside the fusing belt 41. The pad 42 extends in parallel to an extending direction of the central axis R of the pressurizing roller 46. The pad 42 presses the fusing belt 41 from the inside of the fusing belt 41.

The heater 43 is provided inside the heating roller 44. The heater 43 extends in parallel to the extending direction of the central axis R of the pressurizing roller 46. The heater 43 heats, via a heating roller 44, the fusing belt 41 to a predetermined target temperature. A halogen lamp is used as the heater 43, for example.

The heating roller 44 has a cylindrical shape and is provided inside the fusing belt 41. The heating roller 44 heats the fusing belt 41 and follows rotation of the fusing belt 41.

The pad frame 45 is provided inside the fusing belt 41. The pad frame 45 extends in parallel to the extending direction of the central axis R of the pressurizing roller 46. A groove 45*a* is formed in the pad frame 45. A protrusion 421 of the pad 42 is inserted in the groove 45*a*. With this configuration, the pad frame 45 holds the pad 42.

The pressurizing roller 46 is provided at a position opposite to the pad 42 across the fusing belt 41 at the outside of the fusing belt 41. The pressurizing roller 46 presses, from the outside of the fusing belt 41, a position opposite to the pad 42 of the fusing belt 41, thereby forming the fusing nip NP between the pressurizing roller 46 and the fusing belt 41. The pressurizing roller 46 is rotationally driven in a direction indicated by the arrow AR11. The fusing belt 41 follows rotation of the pressurizing roller 46 and rotates in a direction indicated by an arrow AR12.

The outer periphery surface of the pressurizing roller 46 includes a material (for example, rubber) softer than the pad 42. With this configuration, with the pressurizing roller 46 press-contacted with the fusing belt 41, the outer periphery surface of the pressurizing roller 46 deforms along the shape of the pad 42, and the pad 42 hardly deforms. The surface of the pressurizing roller 46 at the fusing nip NP is more recessed toward the central axis R side than a surface 46*a* with the fusing nip NP not formed. The surface rigidity (rubber rigidity) of the outer periphery surface of the pressurizing roller 46 is preferably 40° or more to 60° or less.

Note that, the fusing apparatus 40 may further include a sliding sheet provided in a portion where at least the pad 42 and the fusing belt 41 are in contact with each other. The sliding sheet includes a sheet material containing glass fibers, and a fluorine-based resin formed so as to cover the sheet material. Unevenness is formed on a surface of the sheet material on the fusing belt 41 side of the sheet material, and a lubricant including, for example, a fluorine-based grease having viscosity and excellent heat resistance is held on the unevenness portion. Providing the sliding sheet reduces heat transmission from the fusing belt 41 to the pad 42, thereby increasing a heat resistance temperature of the pad 42. Furthermore, such a configuration enables reduction in contact resistance between the fusing belt 41 and the pad 42; thus, a lubricant can be easily applied to the inner peripheral surface of the fusing belt 41.

An extending direction of the pad 42, a rotary shaft direction of the heating roller 44, and the central axis R direction (rotary shaft direction) of the pressurizing roller 46 are parallel to each other.

The fusing apparatus 40 causes the fusing belt 41 to follow the pressurizing roller 46 rotating, with tension acted on the fusing belt 41 by the biasing part (not illustrated). The fusing apparatus 40 then fuses a toner image on a sheet at the fusing nip NP formed by press-contacting the heated fusing belt 41 with the pressurizing roller 46 by using the pad 42.

Figure 4A:
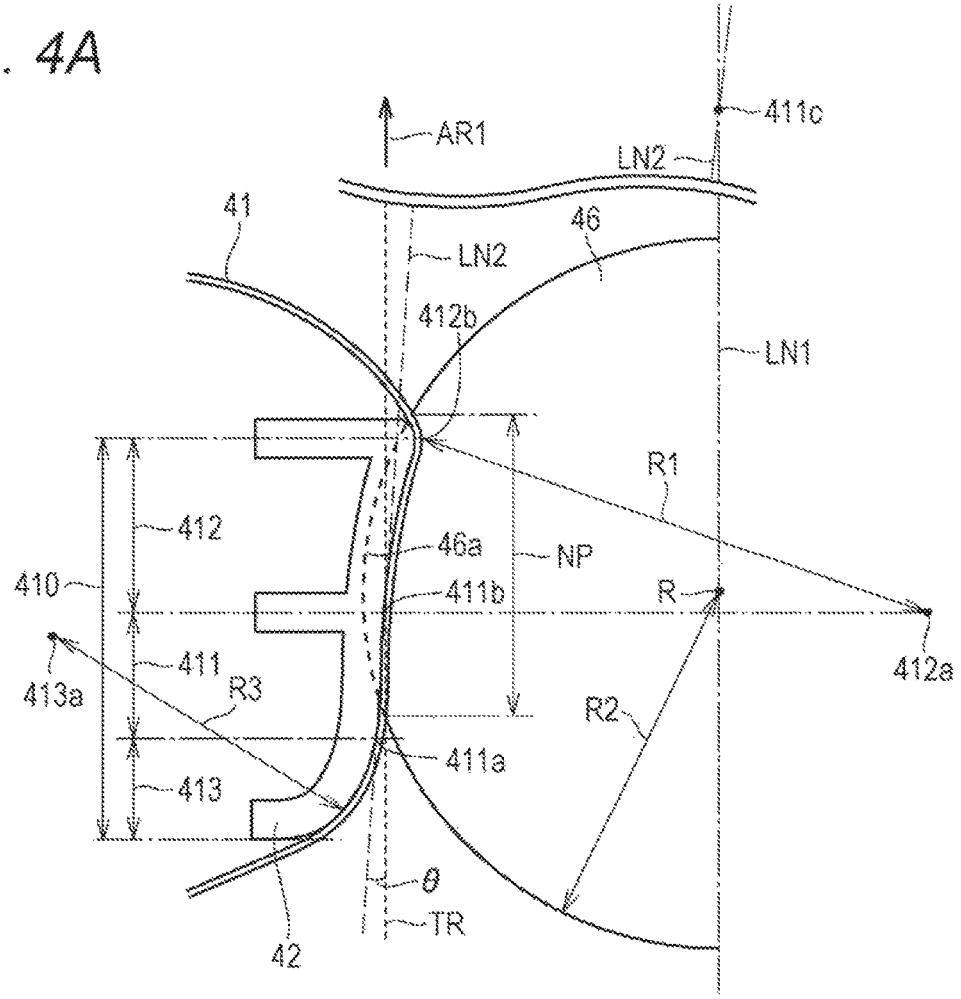
FIGS. 4A and 4B are views each explaining in detail a shape of a surface of a pad facing a pressurizing roller via a fusing belt in the embodiment of the present invention.
Figure 4B:
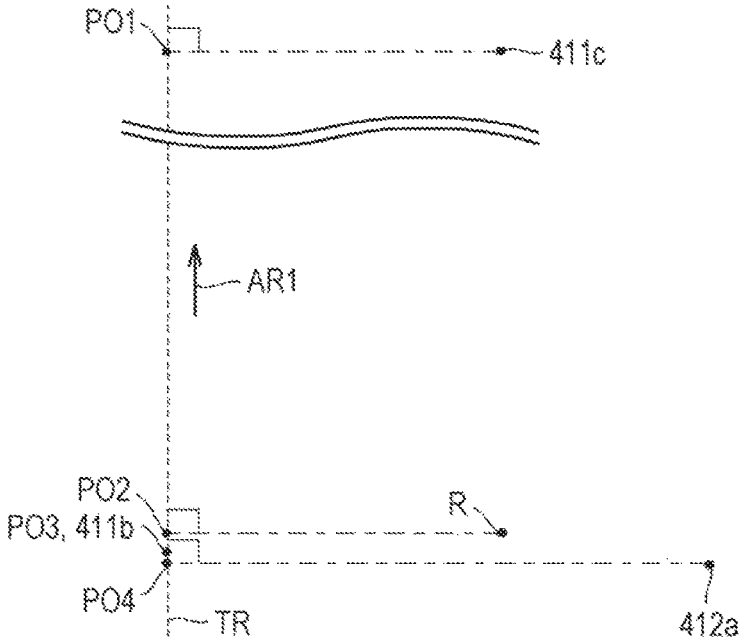

FIGS. 4A and 4B are views each explaining in detail a shape of a surface 410 of the pad 42 facing a pressurizing roller 46 via the fusing belt 41 of the embodiment of the present invention. FIG. 4A is a cross-sectional view illustrating the shape of the surface 410. FIG. 4B is a view illustrating a position along a sheet conveying direction (indicated by the arrow AR1) for an intersection 411*c*, the central axis R, a downstream-side end 41*b*, and a point 412*a* in FIG. 4A. Note that, "a position along a sheet conveying direction at a certain point" means a position of an intersection of a perpendicular line extending from a certain point to the sheet conveying direction (conveying path TR) and the sheet conveying direction. FIG. 4A only illustrates a configuration of the fusing belt 41, the pad 42, and the pressurizing roller 46 in the fusing apparatus 40.

With reference to FIGS. 3 to 4B, the surface 410 of the pad 42 facing the pressurizing roller 46 via the fusing belt 41 includes a plane surface 411, a curved surface 412 (one example of curved surface), and a curved surface 413 (another example of curved surface). The plane surface 411 is interposed between the curved surface 412 and the curved surface 413, in the sheet conveying direction indicated by the arrow AR1. The plane surface 411 includes an upstream-side end 411*a* that is an end on the upstream side in the sheet conveying direction, and a downstream-side end 411*b* that is an end on the downstream side in the sheet conveying direction.

A straight line passing though the central axis R of the pressurizing roller 46 and parallel to the sheet conveying direction is defined as a straight line LN1. When viewed from the cross-section illustrated in FIG. 4A, the upstream-side end 411*a* of the plane surface 411 is away from the straight line LN1 farther than the downstream-side end 411*b* of the plane surface 411.

Additionally, when viewed from the cross-section illustrated in FIG. 4A, a straight line extending the plane surface 411 is defined as a straight line LN2. The straight line LN2 inclines to the straight line LN1 (in FIG. 4A, part of the straight line LN1 and the straight line LN2 is not illustrated). A position PO1 along the sheet conveying direction of the intersection 411*c* of the straight line LN1 and the straight line LN2 is located on the downstream side (upper side in FIG. 4B) of a position PO3 along the sheet conveying direction of the downstream-side end 411*b* of the plane surface 411.

Moreover, the position PO3 along the sheet conveying direction of the downstream-side end 411*b* of the plane surface 411 is on the farther upstream side than a position PO2 (lower side in FIG. 4B) along the sheet conveying direction of the central axis R of the pressurizing roller 46.

Furthermore, when viewed from the cross-section illustrated in FIG. 4A, the inclination angle θ of the plane surface 411 to the straight line LN1 passing through the central axis R of the pressurizing roller 46 and parallel to the sheet conveying direction (straight line LN2) is preferably 0.5° or more to 25° or less. As one example, the inclination angle θ is 4.8°.

The curved surface 412 is adjacent to the plane surface 411 at the downstream-side end 411*b* of the plane surface 411. The curved surface 412 has an arc shape with the curvature center at the point 412*a*, and has a curvature radius R1. The curvature radius R1 is preferably greater than the curvature radius R2 of the outer periphery surface of the pressurizing roller 46 with the fusing nip NP not formed, and is preferably twice or less the curvature radius R2. Making the curvature radius R1 larger than the curvature radius R2 enables the prevention of rapid increase in pressure on the downstream side of the fusing nip NP. Making the curvature radius R1 equal to or less than twice the curvature radius R2 enables gradual increase in pressure toward from the center of the fusing nip NP to the outlet side thereof.

The point 412*a* is located at a position different from the central axis R of the pressurizing roller 46. The position PO2 along the sheet conveying direction of the central axis R is located on the downstream side (upper side in FIG. 4B) of a position PO4 along a sheet conveying direction of the point 412*a*. The point 412*a* is located on the pressurizing roller 46 side (right side in FIG. 4A) of the surface 410 of the pad 42 facing the pressurizing roller 46 via the fusing belt 41.

Additionally, a part 412*b* that protrudes most to the pressurizing roller 46 side of the curved surface 412 forms a portion of the fusing nip NP.

The curved surface 413 is adjacent to the plane surface 411 on the upstream-side end 411*a* of the plane surface 411. The curved surface 413 has an arc shape with the curvature center at the point 413*a*, and has a curvature radius R3. The point 413*a* is on the side opposite to the point 412*a*, based on the surface 410 of the pad 42 facing the pressurizing roller 46 via the fusing belt 411. Therefore, the curvature radius R1 of the curved surface 412 and the curvature radius R3 of the curved surface 413 have mutually different reference signs.

Note that, in the present embodiment of the present invention, a configuration is described in which the upstream-side end 411*a* of the plane surface 411 does not form a portion of the fusing nip NP. The upstream-side end 411*a* of the plane surface 411 (the entire plane surface 411), however, may form a portion of the fusing nip NP.

According to the present embodiment, the upstream-side end 411*a* of the plane surface 411 is away from the straight line LN1 farther than the downstream-side end 411*b*, thereby decreasing pressure on an inlet side of the fusing nip NP (upstream side of sheet conveying direction). Consequently, pressure applied by the pressurizing roller 46 can be concentrated on an outlet side (downstream side of sheet conveying direction) of the fusing nip NP. Additionally, the surface constituting fusing nip NP includes the plane surface 411, which provides a clear boundary where increase in pressure on the inlet side of the fusing nip NP starts. Furthermore, the curved surface 412 allows increase in pressure on the outlet side of the fusing nip NP. As a result, pressure to be applied to a sheet at the fusing nip NP can gradually increase along the sheet conveying direction (from the upstream side to the downstream side).

Figure 5A:
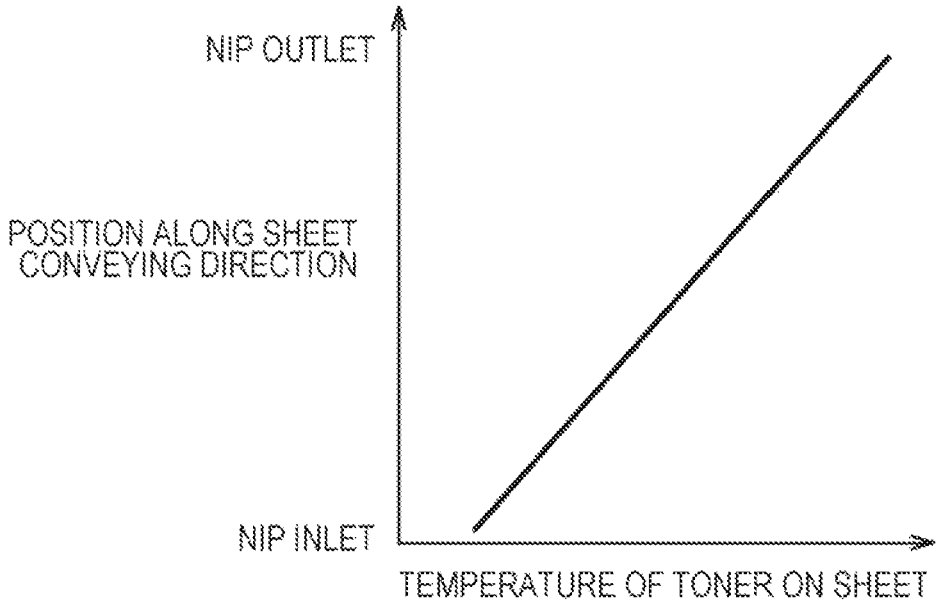
FIGS. 5A and 5B are graphs each schematically indicating a variation in temperature of a sheet passing through the fusing nip and a distribution in pressure of the fusing nip.
Figure 5B:
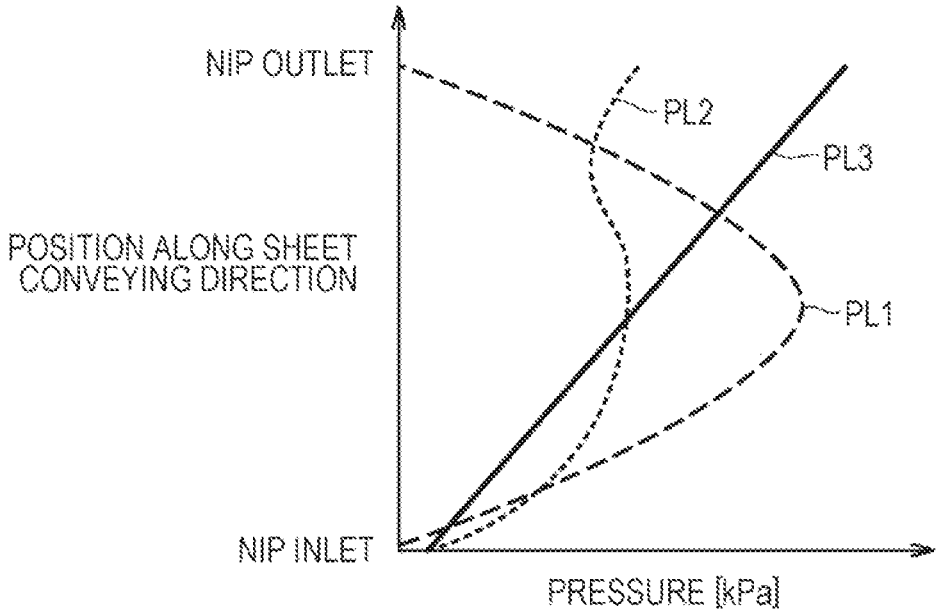

FIGS. 5A and 5B are graphs each schematically indicating a variation in temperature of a sheet passing through a fusing nip and a distribution in pressure of the fusing nip. FIG. 5A is the graph schematically indicating the variation in temperature of the sheet passing through the fusing nip. FIG. 5B is the graph schematically indicating the distribution in pressure of the fusing nip. A line PL1 in FIG. 5B indicates a distribution in pressure in a first comparative example having a configuration that employs a cylindrical fusing roller instead of the fusing belt. A line PL2 in FIG. 5B indicates a distribution in pressure in a second comparative example having a configuration in which a surface of the pad facing the pressurizing roller via the fusing belt includes a single plane surface, and the plane is inclined with respect to a straight line passing through the center axis of the pressure roller and parallel to the paper conveyance direction. A line PL3 in FIG. 5B indicates the distribution in pressure in the present embodiment.

With reference to FIG. 5A, a sheet is heated, for example, by the fusing belt and the pressurizing roller when passing through the fusing nip. Accordingly, the temperature of the toner on the sheet passing through the fusing nip gradually increase as the sheet moves in the fusing nip. As a result, the temperature of the toner on the sheet becomes maximum near the outlet side of the fusing nip (the downstream side in the sheet conveying direction).

With reference to FIG. 5B, for the first comparative example (the line PL1 in FIG. 5B), the fusing nip is formed by the cylindrical fusing roller and the cylindrical pressurizing roller. With this configuration, pressure to be applied to the sheet at a substantially center position of the fusing nip becomes maximum, and thus pressure will not increase near the outlet side of the fusing nip. For the second comparative example (the line PL2 in FIG. 5B), the pad includes the single plane surface. With this configuration pressure locally decreases in an area from the center portion in the sheet conveying direction to the downstream-side end of the fusing nip. Therefore, the pressure cannot be increased near the outlet side of the fusing nip.

As described above, in the first and second comparative examples, pressure cannot be increased near the outlet side of the fusing nip that is a position where the temperature of the toner on the sheet becomes maximum. Accordingly, heat of the fusing apparatus will not be sufficiently used for fusing, thereby causing a fusing failure when the fusing temperature is set low.

Conversely, according to the present embodiment (the line PL3 in FIG. 5B), pressure on the inlet side of the fusing nip decreases and pressure on the outlet side thereof increases. Accordingly, at the fusing nip NP, pressure applied to the sheet gradually increases along the sheet conveying direction (from the upstream side to the downstream side). Thus, the temperature of the toner on the sheet can be sufficiently increased until the pressure applied to the sheet reaches its peak. As a result, heat of the fusing apparatus can be sufficiently used for fusing, and the fusing temperature can be set low while preventing the fusing failure, thereby reducing power consumption.

Additionally, according to the present embodiment, the position PO1 along the sheet conveying direction of the intersection 411*c* of the straight line LN1 and the straight line LN2 is located on the downstream side (upper side in FIGS. 4A and 4B) of the position PO3 along the sheet conveying direction of the downstream-side end 411*b* of the plate surface 411. Therefore, a position where pressure becomes maximum in the fusing nip NP can be shifted from the center of the fusing nip NP to the downstream side in the sheet conveying direction.

Moreover, according the present embodiment, the part 412*b* that protrudes most to the pressurizing roller 46 side of the curved surface 412 forms a portion of the fusing nip NP, and presses the pressurizing roller 46 via the fusing belt 41, whereby pressure at the part 412*b* can become maximum in the fusing nip NP.

Furthermore, according to the present embodiment, the certain point 412*a* that is the curvature center of the curved surface 412 and the point 413*a* that is the curvature center of the curved surface 413 are located on the mutually different sides, based on the surface 410. Therefore, the pad 42 can be separated from the pressurizing roller 46 on the curved surface 413 that is on the inlet side of the fusing nip NP.

The inventor of the present application examined, in the fusing apparatus 40 of the present embodiment, a relationship between the surface rigidity (rubber rigidity) of the pressurizing roller 46, and a distribution pressure and image quality at the fusing nip NP. Specifically, five types of pressurizing rollers 46 mutually having a surface rigidity of 30°, 40°, 50°, 60°, and 70° were prepared to carry out a test with the fusing apparatus 40 including the individual pressurizing roller 46. Specifically, for five types of the fusing apparatuses 40 including the pressurizing rollers 46 mutually having the surface rigidities, the inventor examined whether decrease in pressure was observed (monotone increase in pressure was observed) from the inlet side of the fusing nip NP to a position of peak pressure (position where pressure reached its peak), whether peak pressure in the fusing nip NP became 50 kPa or greater, and a fusing temperature required to obtain image quality equal to conventional image quality.

FIG. 6 is a table indicating a relationship between the surface rigidity (rubber rigidity) of the pressurizing roller 46, pressure inclination, peak pressure, and image quality at the fusing nip NP, in the fusing apparatus 40 of the embodiment of the present invention.

The column of "pressure inclination" in FIG. 6 indicates the results of the examination on whether decrease in pressure was observed from the inlet side of the fusing nip NP to the position where pressure reached its peak. Specifically, a ○ mark is written for indicating a case of no decrease in pressure in a section from the inlet side of the fusing nip NP to the position where pressure reached its peak. A x mark is written for indicating a case of decrease in pressure in the section from the inlet side of the fusing nip NP to the position where pressure reached its peak.

The column of "peak pressure" in FIG. 6 indicates the result of investigation on whether the peak pressure in the fusing nip NP is 50 kPa or greater. Specifically a ○ mark is written for indicating a case where the peak pressure in the fusing nip NP was 50 kPa or greater. A x mark is written for indicating a case where the peak pressure in the fusing nip NP was less than 50 kPa.

In the column of "image quality" in FIG. 6 indicates the results of the examination on whether the decrease level of the fusing temperature required to obtain image quality equal to conventional image quality is 5° C. or higher. Specifically, a ○ mark is written for indicating a case where the decrease level of the fusing temperature required to obtain image quality equal to conventional image quality was 5° C. or higher. A x mark is written for indicating a case where the decrease level of the fusing temperature necessary for obtaining image quality equal to conventional image qualities was less than 5° C.

With reference to FIG. 6, for the fusing apparatuses 40 including the pressurizing rollers 46 mutually having a surface rigidity of 40°, 50°, or 60°, no decrease in pressure was observed in the section from the inlet side of the fusing nip NP to the position where pressure reached its peak, and the peak pressure in the fusing nip NP was 50 kPa or greater. Consequently, the fusing temperature required to obtain image quality equal to conventional image quality could be decreased by 5° C. or higher. Conversely, for the fusing apparatus 40 including the pressurizing roller 46 having a surface rigidity of 30°, pressure decrease was observed in the section from the inlet side of the fusing nip NP to the position where pressure reached its peak, and the peak pressure in the fusing nip NP was less than 50 kPa. Consequently, the fusing temperature necessary for obtaining an image quality equal to conventional image qualities failed to decrease by 5° C. or higher. For the fusing apparatus 40 including the pressurizing roller 46 having a surface rigidity of 70°, although the peak pressure in the fusing nip NP was 50 kPa or greater, pressure decrease was observed in the section from the inlet side of the fusing nip NP to the position where pressure reached its peak. Thus, the fusing temperature required to obtain the image quality equal to conventional image quality failed to decrease by 5° C. or higher.

According to the above results, the inventor found that when the surface rigidity (rubber rigidity) of the outer periphery surface of the pressurizing roller 46 was 40° to 60°, pressure applied to the sheet at the fusing nip NP gradually increased successfully along the sheet conveying direction, thereby decreasing the fusing temperature by the corresponding amount, while maintaining the image quality.

Furthermore, for the fusing apparatus 40 of the present embodiment, the inventor of the present application prepared six types of pads 42 to carry out a test with the fusing apparatuses 40 each including the individual pad 42. The plane surfaces 411 of the pads 42 mutually have an inclination angle θ of 0°, 0.5°. 10°, 20°, 25°, and 30° to the straight line LN1 passing through the central axis R of the pressurizing roller 46 and parallel to the sheet conveying direction. Specifically, for each of the six types of the fusing apparatuses 40 mutually having the inclination angle θ, the inventor examined whether there is no pressure decrease from the inlet side of the fusing nip NP to the position where the pressure reached its peak (whether the pressure monotonically increases), and a fusing temperature necessary for obtaining image quality equal to conventional image qualities.

FIG. 7 is a table indicating a relationship between inclination angle θ of the plane surface 411 of the fusing belt 41, pressure inclination, and image quality at a fusing nip NP, in the fusing apparatus 40 of the embodiment of the present invention. Note that, a ○ mark or a mark written in the columns of "pressure inclination" and "image quality" in FIG. 7 has meanings similar to the meanings in FIG. 6.

With reference to FIG. 7, for the fusing apparatuses 40 each including the plane surface 411 having an inclination angle θ of 0.5°, 10°. 20°, or 25°, no pressure decrease was observed in the section from the inlet side of the fusing nip NP to the position where pressure reached its peak. Consequently, the fusing temperature required to obtain image quality equal to conventional image quality could be decreased by 5° C. or higher. For the fusing apparatus 40 including the plane surface 411 having an inclination angle θ of 0° or 30°, pressure decrease was observed in the section from the inlet side of the fusing nip NP to the position where the pressure reached its peak. Consequently, the fusing temperature required to obtain the image quality equal to conventional image quality failed to decrease by 5° C. or higher.

According to the above results, the inventor found that when the inclination angle θ of the plane surface 411 was 0.5° to 25°, the pressure applied to the sheet at the fusing nip NP gradually increased successfully along the sheet conveying direction, thereby decreasing the fusing temperature by the corresponding amount, while maintaining the image quality.

Modifications

Figure 8:
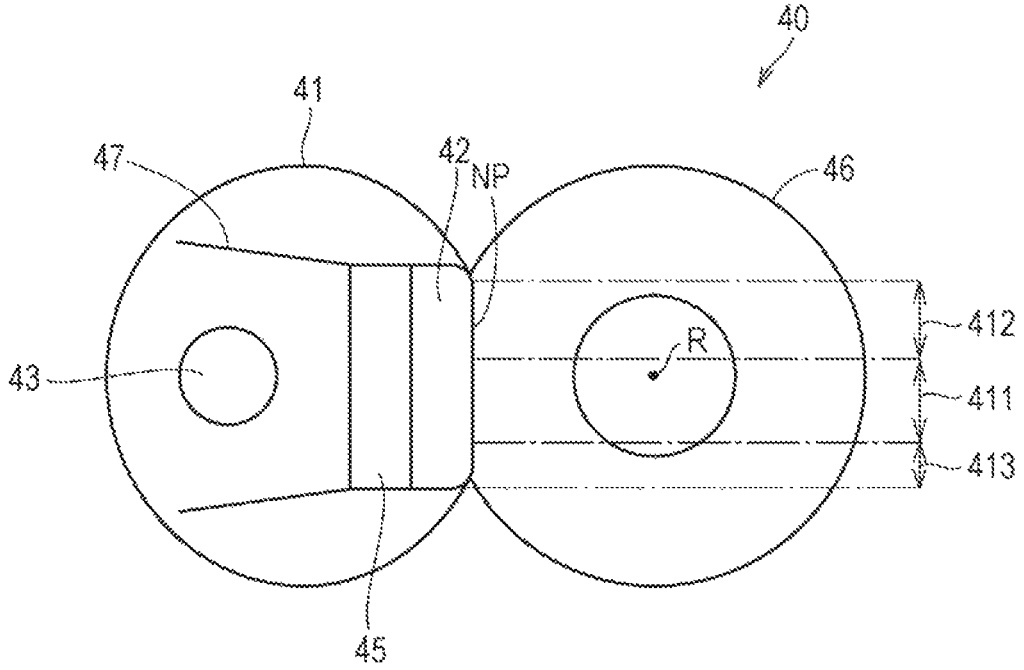
FIG. 8 is a cross-sectional view schematically illustrating a configuration of the fusing apparatus of a first modification of the embodiment of the present invention.

FIG. 8 is a cross-sectional view schematically illustrating a configuration of the fusing apparatus 40 of a first modification of the embodiment of the present invention. Note that, FIG. 8 illustrates a cross-section orthogonal to the central axis R of the pressurizing roller 46.

With reference to FIG. 8, the fusing apparatus 40 in the present modification employs a direct heating system though which a fusing belt is heated with a heat source. The fusing apparatus 40 includes the fusing belt 41 (one example of belt), the pad 42 (one example of pressing member), the heater 43, the pad frame 45, the pressurizing roller 46 (one example of roller), and a reflecting member 47.

The fusing belt 41 is not wound around the heating roller, thus, the fusing belt 41 is supported by pressing a portion near the fusing nip NP by using the pad 42. A surface of the pad 42 facing the pressurizing roller 46 via the fusing belt 41 includes a plane surface 411, the curved surface 412, and the curved surface 413. The reflecting member 47 reflects, toward the inner surface of the fusing belt 41, radiant heat from the heater 43. Providing the reflecting member 47 makes it possible to efficiently heat the fixing belt 41 by using radiant heat directly toward the fusing belt 41 from the heater 43 and radiant heat that is directed from the heater 43 to the reflecting member 47 and then reflected on the reflecting member 47 to be directed toward the fusing belt 41.

Figure 9:
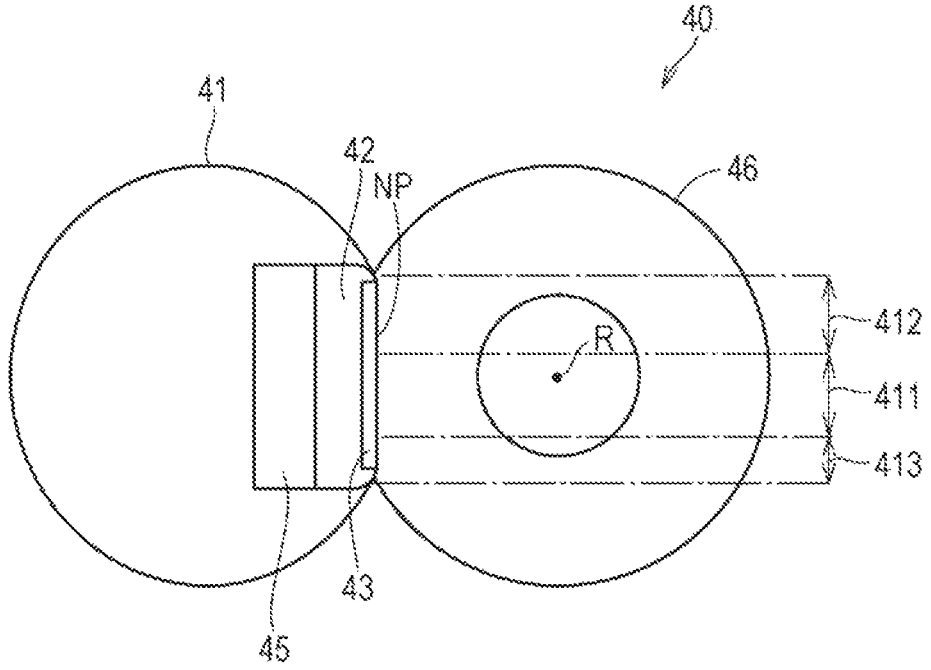
FIG. 9 is a cross-sectional view schematically illustrating a configuration of the fusing apparatus according to a second modification of the embodiment of the present invention.

FIG. 9 is a cross-sectional view schematically illustrating a configuration of the fusing apparatus 40 according to a second modification of the embodiment of the present invention. Note that, FIG. 9 illustrates a cross-section orthogonal to the central axis R of the pressurizing roller 46.

With reference to FIG. 9, the fusing apparatus 40 in the present modification has the pad 42 serving as a heater. The fusing apparatus 40 includes the fusing belt 41 (one example of belt), the pad (nip forming member) 42 (one example of pressurizing member), the heater 43, and the pad frame 45, and the pressurizing roller 46 (one example of roller). The fusing belt 41 is not wound around the heating roller 44; thus, the fusing belt 41 is supported by pressing a portion in the vicinity of the fusing nip NP by using the pad 42. The heater 43 is incorporated in the pad 42 and generates heat in the pad 42. This allows the pad 42 to heat the fusing belt 41 in the fusing nip NP. A surface of the pad 42 facing the pressurizing roller 46 via the fusing belt 41 includes a plane surface 411, the curved surface 412, and the curved surface 413. The plane surface 411 and the curved surface 412, and the curved surface 413 serve as a heating body.

Figure 10:
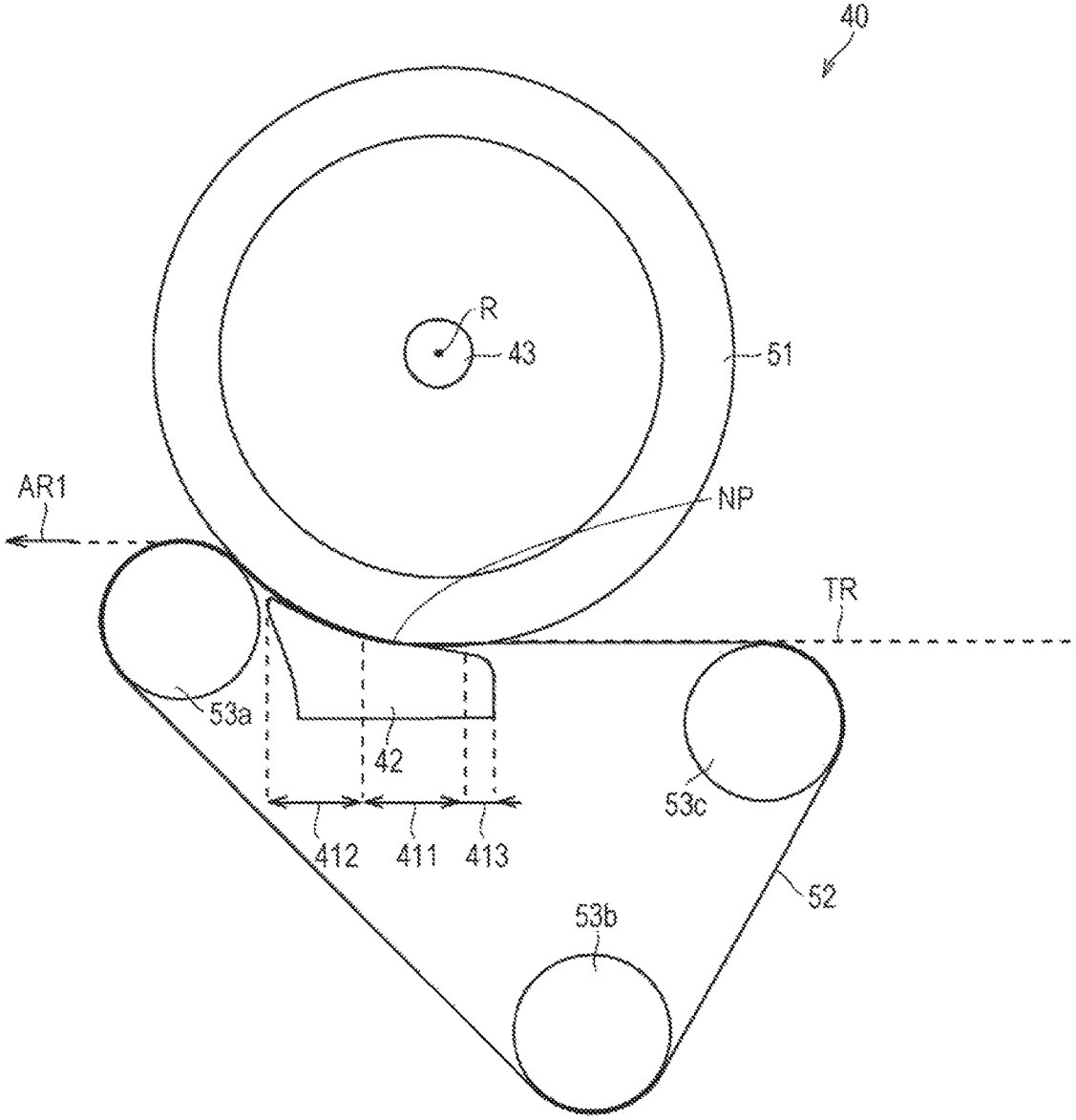
FIG. 10 is a cross-sectional view schematically illustrating a configuration of the fusing apparatus in a third modification of the embodiment of the present invention.

FIG. 10 is a cross-sectional view schematically illustrating a configuration of the fusing apparatus 40 in a third modification of the embodiment of the present invention. Note that, FIG. 10 illustrates a cross-section orthogonal to the central axis R of a fusing roller 51.

With reference to FIG. 10, the fusing apparatus 40 in the present modification employs so-called a lower belt. The fusing apparatus 40 includes the fusing roller 51 (one example of roller); a lower belt 52 (one example of belt); and rollers 53*a*. 53*b*, and 53*c*; the pad 42 (one example of pressing member); and the heater 43. The fusing roller 51 has a cylindrical shape. The heater 43 is incorporated in the fusing roller 51 and heats the fusing roller 51. The fusing roller 51 and the lower belt 52 form the fusing nip NP. A portion of the lower belt 52 near the fusing nip NP is pressed by the pad 42. The lower belt 52 is wound around the rollers 53*a*, 53*b*, and 53*c*; and the pad 42. A surface of the pad 42 facing the fusing roller 51 via the lower belt 52 includes a plane surface 411, the curved surface 412, and the curved surface 413.

Note that, configurations except those of the above-described image forming apparatus and the fusing apparatus in the first, second, and third modifications are the same as the configuration of the image forming apparatus and the fusing apparatus in the embodiment described above. Therefore, the same members are denoted with the same reference signs, and the descriptions thereof will be omitted.

[Others]

Although embodiments of the present invention have been described and illustrated in detail, the disclosed embodiments are made for purposes of illustration and example only and not limitation. The scope of the present invention should be interpreted by terms of the appended claims rather than by the above description, and is intended to include all modifications within the meaning and the range of equivalency of the claims.

What is claimed is:

1. A fusing apparatus that fuses a toner image on a recording medium by passing the recording medium through a fusing nip, comprising:

a rotating endless belt;

a pressing member that is provided inside the belt and presses the belt from an inside of the belt; and a roller that is provided outside the belt and forms the fusing nip between the roller and the belt by pressing, from an outside of the belt, a position where the belt faces the pressing member, wherein a surface of the pressing member facing the roller via the belt includes:

a plane surface, and a curved surface adjacent to the plane surface at a downstream-side end in a conveying direction of the recording medium of the plane surface, and when viewed from a cross-section orthogonal to a central axis of the roller, an upstream-side end of the conveying direction of the plane surface is away from a straight line passing through the central axis of the pressure roller and parallel to the conveying direction, farther than the downstream-side end in the conveying direction of the plane surface, wherein a position along the conveying direction of the downstream-side end in the conveying direction of the plane surface is located on an upstream side of a position along the conveying direction of the central axis of the roller.

2. The fusing apparatus according to claim 1, wherein when viewed from the cross-section orthogonal to the central axis of the roller, a position along an intersection of a straight line extending the plane surface and a straight line passing through the central axis of the roller and parallel to the conveying direction is located on a downstream side of a position along the conveying direction of the downstream-side end in the conveying direction of the place surface.

3. The fusing apparatus according to claim 1, wherein a curvature center of the curved surface is at a position different from the central axis of the roller.

4. The fusing apparatus according to claim 1, wherein a part that protrudes most to the roller in the curved surface forms a part of the fusing nip.

5. The fusing apparatus according to claim 1, wherein a rubber rigidity of an outer periphery surface of the roller is 40° or more to 60° or less.

6. The fusing apparatus according to claim 1, wherein when viewed from a cross-section orthogonal to the central axis of the roller, an inclination angle of the plane surface to a straight line passing through the central axis of the roller and parallel to the conveying direction is 0.5° or more to 25° or less.

7. An image forming apparatus, comprising:

an image former that forms the toner image on the recording medium; and the fusing apparatus according to claim 1.

8. A fusing apparatus that fuses a toner image on a recording medium by passing the recording medium through a fusing nip, comprising:

a rotating endless belt;

a pressing member that is provided inside the belt and presses the belt from an inside of the belt; and a roller that is provided outside the belt and forms the fusing nip between the roller and the belt by pressing, from outside of the belt, a position where the belt faces the pressing member, wherein a surface of the pressing member facing the roller via the belt includes:

a plane surface, and a curved surface adjacent to the plane surface at a downstream-side end in a conveying direction of the recording medium of the plane surface, and when viewed from a cross-section orthogonal to a central axis of the roller, an upstream-side end of the conveying direction of the plane surface is away from a straight line passing through the central axis of the pressure roller and parallel to the conveying direction, farther than the downstream-side end in the conveying direction of the plane surface, wherein a curvature radius of the curved surface is greater than a curvature radius of an outer periphery surface of the roller with the fusing nip not formed.

9. A fusing apparatus that fuses a toner image on a recording medium by passing the recording medium through a fusing nip, comprising:

a rotating endless belt;

a pressing member that is provided inside the belt and presses the belt from an inside of the belt; and a roller that is provided outside the belt and forms the fusing nip between the roller and the belt by pressing, from outside of the belt, a position where the belt faces the pressing member, wherein a surface of the pressing member facing the roller via the belt includes:

a plane surface, and a curved surface adjacent to the plane surface at a downstream-side end in a conveying direction of the recording medium of the plane surface, and when viewed from a cross-section orthogonal to a central axis of the roller, an upstream-side end of the conveying direction of the plane surface is away from a straight line passing through the central axis of the pressure roller and parallel to the conveying direction, farther than the downstream-side end in the conveying direction of the plane surface, wherein a curvature radius of the curved surface is twice or less a curvature radius of an outer periphery surface of the roller with the fusing nip not formed.

10. A fusing apparatus that fuses a toner image on a recording medium by passing the recording medium through a fusing nip, comprising:

a rotating endless belt;

a pressing member that is provided inside the belt and presses the belt from an inside of the belt; and a roller that is provided outside the belt and forms the fusing nip between the roller and the belt by pressing, from outside of the belt, a position where the belt faces the pressing member, wherein a surface of the pressing member facing the roller via the belt includes:

a plane surface, and a curved surface adjacent to the plane surface at a downstream-side end in a conveying direction of the recording medium of the plane surface, and when viewed from a cross-section orthogonal to a central axis of the roller, an upstream-side end of the conveying direction of the plane surface is away from a straight line passing through the central axis of the pressure roller and parallel to the conveying direction, farther than the downstream-side end in the conveying direction of the plane surface, wherein a curvature center of the curved surface is at a position different from the central axis of the roller, and wherein a position along the conveying direction of the central axis of the roller is on a downstream side of a position along the curvature center of the curved surface.

11. A fusing apparatus that fuses a toner image on a recording medium by passing the recording medium through a fusing nip, comprising:

a rotating endless belt;

a pressing member that is provided inside the belt and presses the belt from an inside of the belt; and a roller that is provided outside the belt and forms the fusing nip between the roller and the belt by pressing, from an outside of the belt, a position where the belt faces the pressing member, wherein a surface of the pressing member facing the roller via the belt includes:

a plane surface, and a curved surface adjacent to the plane surface at a downstream-side end in a conveying direction of the recording medium of the plane surface, and when viewed from a cross-section orthogonal to a central axis of the roller, an upstream-side end of the conveying direction of the plane surface is away from a straight line passing through the central axis of the pressure roller and parallel to the conveying direction, farther than the downstream-side end in the conveying direction of the plane surface, wherein a surface of the pressing member facing the roller via the belt further includes another curved surface adjacent to the plane surface at the upstream-side end in the conveying direction of the recording medium of the plane surface, and the curvature center of the curved surface and the curvature center of the other curved surface are located on mutually different sides, based on the surface of the pressing member facing the roller via the belt.

* * * * *